United States Patent [19]

Troubridge

[11] Patent Number: 4,877,008

[45] Date of Patent: Oct. 31, 1989

[54] CROSSBOW TRIGGER MECHANISM

[76] Inventor: William C. Troubridge, R.R. No. 1, Breslau, Ontario, Canada, N0B 1M0

[21] Appl. No.: 675,543

[22] Filed: Nov. 28, 1984

[30] Foreign Application Priority Data

Apr. 17, 1984 [CA] Canada ..... 452246

[51] Int. Cl.[4] ..... F41B 5/00

[52] U.S. Cl. ..... 124/25

[58] Field of Search ..... 124/25, 35 R, 35 A

[56] References Cited

U.S. PATENT DOCUMENTS

| | | | |
|---|---|---|---|
| 1,469,610 | 10/1923 | Ustynik | 124/35 R |
| 2,278,535 | 4/1942 | Dobson | 124/25 |
| 2,500,509 | 3/1950 | Bailey | 124/25 |
| 2,609,810 | 9/1952 | Gruner | 124/25 |
| 2,842,114 | 7/1958 | Duncan | 124/25 |
| 3,490,429 | 1/1970 | Benedict | 124/35 R |
| 3,538,901 | 11/1970 | Switack | 124/35 R |
| 3,788,299 | 1/1974 | Mathews | 124/35 R |
| 4,192,281 | 3/1980 | King | 124/25 |
| 4,206,740 | 6/1980 | Lydon | 124/25 |
| 4,232,649 | 11/1980 | Allen et al. | 124/35 A |
| 4,294,222 | 10/1981 | Pelsue | 124/25 |

FOREIGN PATENT DOCUMENTS

| | | | |
|---|---|---|---|
| 469802 | 12/1950 | Canada | 124/25 |

*Primary Examiner*—Edward M. Coven

*Assistant Examiner*—Benjamin Layno

*Attorney, Agent, or Firm*—R. Craig Armstrong

[57] ABSTRACT

A novel trigger mechanism for a crossbow is disclosed, in which a relatively large mechanical advantage is employed to obtain reduced trigger pressures in comparison with trigger pressures in the prior art. The mechanism has two main components, namely a trigger and a catch, pivotally mounted in a case which is in turn mounted in the crossbow stock. The trigger has a trigger arm extending downwardly from the trigger pivot point and out of the case, and a sear arm extending forwardly and having a rearward-facing sear surface. The catch is installed with its pivot point slightly above the plane of a bowstring entry area in the case, and thus slightly above the plane of the bowstring. The catch has a bowstring-retaining hook portion extending forwardly from the catch pivot point, and a catch arm extending downwardly from the catch pivot point and terminating in a forward-facing sear surface, which is engaged by the sear surface of the trigger sear arm when the crossbow is armed. By virtue of a relatively high mechanical advantage in the catch, of about 4.5 to 1, combined with the mechanical advantage in the trigger and with lubrication and/or polishing of the sear surfaces, low trigger pressure is achieved. The trigger pressure is augmented by means of a spring installed between a portion of the case and the trigger.

12 Claims, 2 Drawing Sheets

CROSSBOW TRIGGER MECHANISM

BACKGROUND OF THE INVENTION

1. Field of the Invention

This invention relates to crossbows, and particularly to trigger mechanisms in crossbows.

The primary objective in a crossbow trigger mechanism is to enable the drawn bowstring to be retained with high tension for maximum propulsive force, while at the same time providing a reliably smooth release with relatively low and predictable trigger pressure. A good trigger mechanism obviously results in greater accuracy being attainable, since a smooth and timely release can be more easily achieved.

Most crossbow trigger mechanisms have the same essential structure, namely a rotatable bowstring-retaining member or "catch" and a trigger which when pulled disengages the catch. Sear surfaces on the catch and trigger engage each other until the trigger is pulled. When the trigger is pulled, the sear surfaces are disengaged, and the catch then rotates under the force of the bowstring tension to release the bowstring and thus project the arrow or other projectile.

In crossbow trigger mechanisms, trigger pressure depends on the mechanical advantage of the trigger itself, and on the force of friction between the sear surfaces of the trigger and catch, since these surfaces slide across each other when the trigger is pulled. The friction between the sear surfaces is a function of the force with which the catch bears against the trigger. Since that force depends on the bowstring draw force and on the mechanical advantage of the catch, it is advantageous to have a large mechanical advantage in the catch, in order to reduce the friction. A typical bowstring draw force, and hence the force acting on the bowstring-retaining portion of the catch, is in the order of 150 pounds.

Friction can of course also be reduced by lubrication and by polishing of the sear surfaces, but such measures alone do not adequately reduce trigger pressure.

Ideally, a crossbow trigger mechanism should be able to reduce the effect of friction to the point where trigger pressure is so low that it becomes necessary or desireable to add means such as a spring to augment the trigger pressure. Spring force is consistent and reliable, producing a more consistent and reliable release point than when friction is the sole or primary variable.

The trigger mechanism should also be relatively compact, so as to avoid the need for a large stock in which the mechanism must be mounted, and so as to permit the trigger to be positioned relatively close to the plane of the bowstring and hence the line of the arrow. It is difficult to construct a mechanism which has a large mechanical advantage in the catch without having an unduly large mechanism case. The mechanism should not only be not too large in terms of depth, but also relatively short, so that the stock need not be unduly long.

A crossbow trigger mechanism must also have a safety to prevent inadvertent release of an arrow.

2. Description of the Prior Art

Many crossbow mechanisms have been known in the past, and many have been patented. Specific examples are the trigger mechanisms shown in Canadian Pat. No. 469,802 (Diehr) and in the following U.S. Pat. Nos. 2,278,535 (Dobson), 2,500,509 (Bailey), 2,609,810 (Gruner), 2,786,461 (Pelsue), 2,842,114 (Duncan), 3,490,429 (Benedict), 3,788,299 (Mathews), 4,192,281 (King), 4,206,740 (Lydon), and 4,294,222 (Pelsue). U.S. Pat. No. 1,469,610 (Ustynik) shows a crossbow-type of trigger mechanism, used to fire a rubber band.

An examination of these patents shows that the mechanical advantage of the catch in particular is in each case limited by the geometry of the mechanism, and particularly by the relative lengths of the lever arms of the catches in relation to their pivot points. In well-known crossbow trigger mechanisms previously known and presently available on the market, trigger pressures are thus generally somewhat higher than can be considered ideal, thus making accuracy difficult to achieve.

SUMMARY OF THE INVENTION

It is an object of the invention to provide a trigger mechanism which employs a relatively high mechanical advantage in relation to trigger mechanisms in the prior art, and which thereby provides a relatively low trigger pressure, thus and otherwise improving on trigger mechanisms in the prior art.

Thus in accordance with the present invention there is provided a novel crossbow trigger mechanism, in a mechanism-containing case adapted for installation in a crossbow stock. The case has a forward-opening bowstring entry area in its upper portion for receiving a bowstring. A trigger is pivotally installed in a lower portion of the case, the trigger having a trigger arm extending downwardly from the trigger pivot point and out of the case, and a sear arm extending forwardly from the trigger pivot point. The sear arm has a rearward-facing sear surface. The sear arm and its sear surface move downwardly when the trigger arm is pulled rearwardly. A catch is pivotally installed in the case, with its pivot point located slightly above the plane of the bowstring entry area and bowstring. The catch has a bowstring-retaining hook portion extending forwardly from the catch pivot point, for pivoting downwardly into the bowstring entry area to retain a bowstring to arm the crossbow and upwardly away from the bowstring entry area to release the bowstring to project an arrow or other projectile. The catch also has a catch arm extending downwardly from the catch pivot point and terminating in a forward-facing sear surface, adapted for engagement by the sear surface of the sear arm of the trigger. Rearward motion of the trigger arm disengages the sear arm sear surface from the catch arm sear surface. When a bowstring is retained by the hook portion of the catch and the trigger is pulled rearwardly, disengaging the catch arm sear surface, the catch rotates about its pivot point by virtue of the force produced by bowstring tension. The hook portion thus pivots upwardly away from the bowstring entry area, thereby releasing the bowstring to project an arrow or other projectile.

In accordance with an aspect of the invention, a relatively large mechanical advantage is produced in the catch by virtue of the construction of the mechanism.

By virtue of the relatively large mechanical advantage in the catch, a low trigger pressure is achieved, and in accordance with another feature of the invention that trigger pressure is augmented by means of a spring installed between an interior portion of the case and a portion of the trigger.

Other features of the invention will be described or will become apparent in the following detailed description of the preferred embodiment.

BRIEF DESCRIPTION OF THE DRAWINGS

In order that the invention may be more clearly understood, the preferred embodiment will be described, by way of example only, with reference to the accompanying drawings, in which.

DETAILED DESCRIPTION OF THE PREFERRED EMBODIMENT

Figure 1:
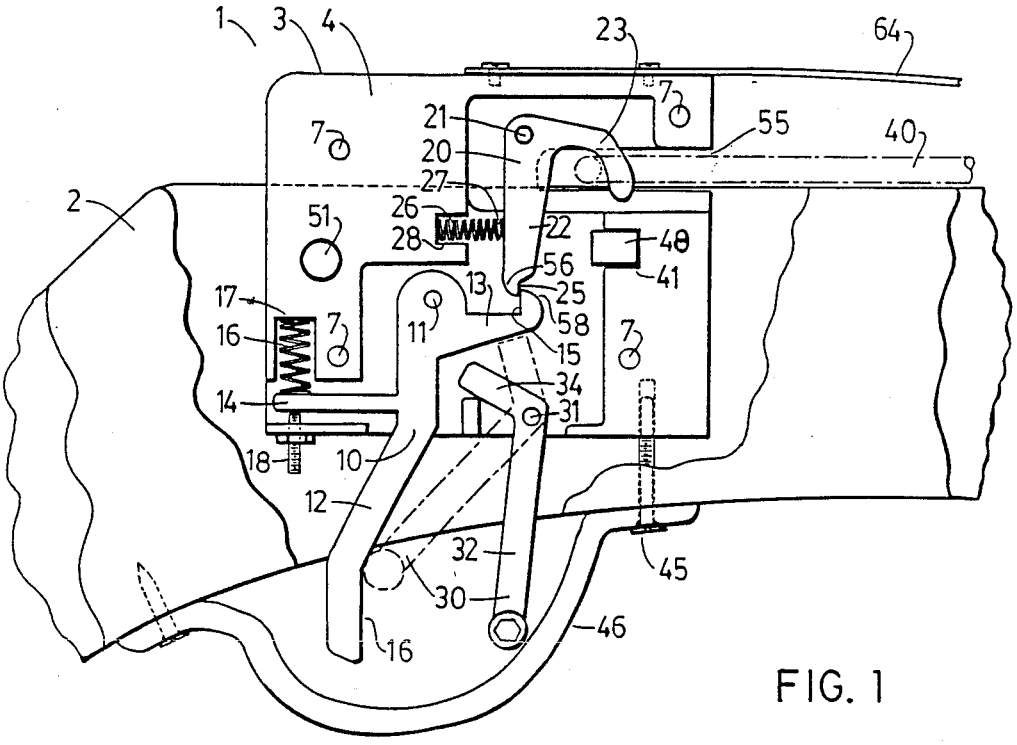
FIG. 1 is a partial sectional drawing of the trigger mechanism mounted in a crossbow stock, shown in a side view.

Referring first to FIG. 1, the crossbow trigger mechanism 1 is shown in section, mounted in the crossbow stock 2.

The three main components of the mechanism are the trigger 10, the catch 20, and the safety 30, pivoting in the case 3 about the trigger pivot pin 11, the catch pivot pin 21, and the safety pivot pin 31 respectively. These three pivot pins are ⅛ inch diameter dowels each one inch in length.

Figure 2:
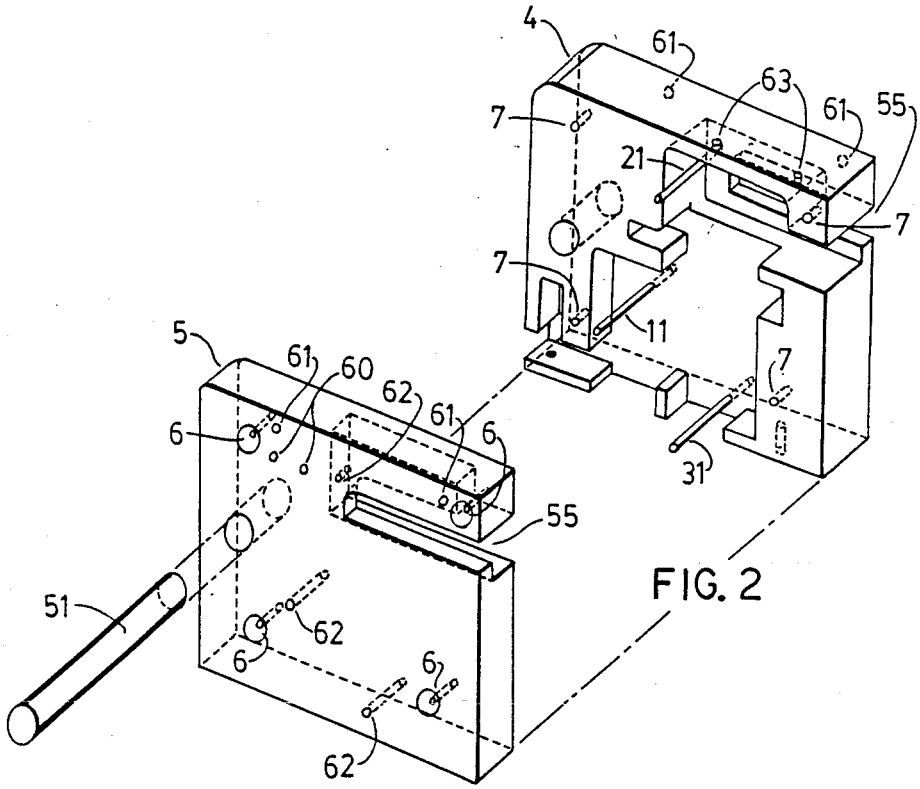
FIG. 2 is an exploded view of the case which contains the trigger mechanism.

As seen in FIG. 2, the case 3 has two main sections, namely the base 4 and the cover 5. Four screws (not shown) fasten the cover to the base through the countersunk holes 6 in the cover, engaging in threaded holes 7 in the base. The case is secured in the crossbow stock by a dowel 51 passing through the case 3 and through the stock 2 on either side of the case, and secondarily by a screw 45 through the trigger guard 46 into the underside of the case.

The cover 5 is recessed to accommodate the hook portion 23 of the catch 20, but otherwise no recesses are necessary, all other elements of the mechanism being accommodated in recesses provided in the base 4. The upper portion of the cover has two threaded holes 60 for a sight mount, and two threaded holes 61 which may be used for a scope mount. Corresponding scope mount holes are provided in the upper portion of the base. The cover also has three holes 62 which receive the three pivot pins 11, 21 and 31 in a press fit. The top of the base has two threaded holes 63 for attachment of an arrow hold-down leaf spring 64 (only partially shown).

The trigger 10 has three main portions, namely the trigger arm 12, the sear arm 13, and the sear adjustment arm 14.

Figure 3:
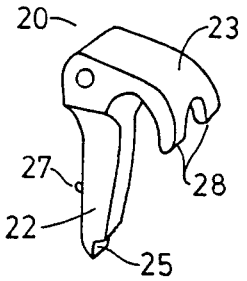
FIG. 3 is a perspective drawing of the catch.

The catch 20 has two main portions, namely the catch arm 22 and the hook portion 23. As seen in FIG. 3, the hook portion 23 has two forks 28 for engaging the string on either side of the arrow.

The mechanism is shown in the cocked position, in which the sear surfaces 15 and 25 of the sear arm and catch arm engage each other. The trigger pivot pin 11 is near the horizontal plane of the engaged sear surfaces, and a mechanical advantage of about 3.2:1 is achieved by virtue of the distance between the trigger pull point 16 and the trigger pivot pin 11 in relation to the distance between the sear surfaces and the trigger pivot pin. Such mechanical advantages are not known in the triggers in the prior art.

The catch pivot pin 21 is positioned above the level of the bowstring 40, thus permitting a relatively long catch arm 22 to be accommodated within the case 3, without having an undesirably large case. The hook portion 23 is relatively short. A mechanical advantage of about 4.5:1 is achieved, being the approximate ratio of the distance between the bearing force line of the sear surfaces and the catch pivot pin to the distance between the plane of the bowstring and the catch pivot pin.

Such mechanical advantages in catches have hitherto not been realized. When the catch pivot point is located below the plane of the bowstring, as is conventional, the length of the catch arm is limited, and generally it has not been possible to attain mechanical advantages in excess of 2 to 1 without unduly increasing the depth of the case. With the structure of the present invention, mechanical advantages in excess of 2 to 1 are easily achieved, and in fact mechanical advantages of 10 to 1 or greater could be easily achieved if desired. From a practical viewpoint, the mechanical advantage of approximately 4.5 to 1 in the preferred embodiment is sufficient to reduce trigger pressure to the point where trigger pressure should be artifically increased by means of a spring, as described hereinafter.

The sear surfaces 15 and 25 of the sear arm and catch arm are oriented at right angles to the radius from the trigger pivot pin 11. Thus when the trigger is pulled, the catch remains virtually stationary while the sear surfaces slide across each other, until the release point is reached. The sear surfaces are made smooth and preferably are lubricated, so that friction is minimized.

A light spring 26 is installed between a boss 27 on the catch arm 22 and a recess 28 in the base 4, to hold the catch in the released position once the trigger has been pulled, so that the hook portion 23 does not interfere with the bowstring being redrawn.

A trigger return spring 16 acts between a recess 17 and the upper surface of the sear adjustment arm 14. A sear engagement adjustment screw 18 acts on the lower surface of the sear adjustment arm, to adjust the overlap of the sear surfaces 15 and 25 to remove excess travel from the trigger before the catch arm is released. The trigger return spring regulates trigger pressure, and also serves to return the sear arm 13 to its proper position for engaging the catch.

With the mechanism released, when the bowstring is drawn into the entry slot 55 provided in the case, it passes under the hook portion and contacts the catch arm, pushing the catch arm backwards. The rounded corner 56 of the catch arm presses against the rounded corner 58 of the sear arm, causing the trigger to rotate out of the way as the catch arm moves farther backwards. Once the catch arm moves far enough backwards, past the point where the sear surfaces are aligned, the trigger return spring causes the sear arm to be pushed up, and the sear surfaces engage when the catch arm is allowed to move forward under the force of the bowstring, now acting on the hook portion.

The safety 30 is shown in FIG. 1 in the disengaged position. As can be seen, the trigger can be pulled with no interference from the safety. However, when the lever portion 32 is pulled back towards the trigger, the safety pivots about the safety pivot pin 31, positioning the stop portion 34 directly under the sear arm 13, thereby preventing the trigger from being pulled to release the mechanism. The safety is held in either the engaged or disengaged position by a spring-loaded detent ball (not shown) in a recess in the base on the underside of the stop portion 34, which engages appropriately positioned angled surfaces on the underside of the stop portion to bias the safety into one position or the other as desired.

A stop 48 of rubber or other suitable resilient material is installed in a recess 41 in the base 4, protruding from the base in the direction of the catch arm. The catch arm strikes the stop when the mechanism is released. The stop absorbs the shock and prevents unnecessary wear and stress on the catch arm and on the case.

The combined effect of minimizing friction at the sear surfaces and producing a relatively large mechanical advantage in the trigger has not been sufficient in the prior art to reduce trigger pressure substantially below 8 to 15 pounds, since typical mechanical advantages in the catches have been limited. However, in the present invention the catch has a mechanical advantage of about 4.5:1 due to the novel construction of the mechanism. The combined effect of minimizing friction and maximizing mechanical advantage is that low trigger pressures have been achieved.

By virtue of the relatively large mechanical advantage which is achieved, forces produced by the bowstring tension are minimized at the trigger location, such that trigger pressure is preferably augmented by the trigger return spring 16. Thus a predictable trigger pressure is achieved, with the pressure increasing smoothly as the trigger is pulled and the trigger return spring is compressed. Obviously, the trigger return spring must not have too large a spring constant, so that the trigger pressure does not increase unduly as the trigger is pulled.

It will be appreciated that the above description relates to a specific embodiment of the invention, provided by way of example only. A number of variations are possible, and would be obvious to those knowledgeable in the field. Such obvious variations are within the scope of the invention as defined and claimed, whether or not expressly recited.

What is claimed as the invention is:

1. A crossbow trigger mechanism comprising:

(a) a mechanism-containing case adapted for installation in a crossbow stock;

(b) a forward-opening bowstring entry area in the upper portion of said case for receiving a bowstring;

(c) a one-piece trigger pivotally installed in a lower portion of said case, said trigger comprising a trigger arm extending downwardly from the trigger pivot point and out of the case and an integral sear arm extending forwardly from said trigger pivot point, said sear arm having a rearward-facing sear surface, such that said sear arm and its sear surface move downwardly when said trigger arm is pulled rearwardly, the length of said sear arm and said trigger arm being such that a mechanical advantage of in excess of 2.1 is achieved; and (d) a catch pivotally installed in said case, its pivot point being slightly above the plane of said bowstring entry area and said bowstring, said catch comprising a bowstring-retaining hook portion extending forwardly form said catch pivot point for pivoting downwardly into said bowstring entry area for retaining a bowstring to arm the crossbow and upwardly away form said bowstring entry area for releasing said bowstring to project an arrow or other projectile, and a catch arm extending downwardly from said catch pivot point, said catch arm terminating in a forward-facing sear surface, said sear surface adapted to be engaged by the sear surface of the sear arm of the trigger, such that rearward motion of the trigger arm disengages the sear arm sear surface from the catch arm sear surface;

whereby, when a bowstring is retained by said bowstring-retaining hook poriton of said catch, and said trigger is pulled rearwardly, the sear surface disengages the catch arm sear surface, and the catch rotates about its pivot point by virtue of the force produced by bowstring tension, whereby the bowstring-retaining hook portion pivots upwardly away from said bowstring entry area, thereby releasing said bowstring to project an arrow or other projectile.

2. A mechanism as recited in claim 1, in which the ratio of the distance between the catch pivot point and the line of the bearing force between sear surfaces to the distance between the catch pivot point and the plane of the bowstring is relatively large, whereby a relatively large mechanical advantage is produced in said catch.

3. A mechanism as recited in claim 2, in which said mechanical advantage in said catch is in excess of 2 to 1.

4. A mechanism as recited in claim 3, further comprising a spring installed between an interior portion of said case and a portion of said trigger, for augmenting trigger pressure.

5. A mechanism as recited in claim 2, in which said mechanical advantage in said catch is in the range of 2-to-1 to 10-to-1.

6. A mechanism as recited in claim 5, further comprising a spring installed between an interior portion of said case and a portion of said trigger, for augmenting trigger pressure.

7. A mechanism as recited in claim 2, in which said mechanical advantage in said catch is in the range of 3-to-1 to 6-to -1.

8. A mechanism as recited in claim 7, further comprising a spring installed between an interior portion of said case and a portion of said trigger, for augmenting trigger pressure.

9. A mechanism as recited in claim 2, in which said mechanical advantage in said catch is approximately 4.5 to 1.

10. A mechanism as recited in claim 9, further comprising a spring installed between an interior portion of said case and a portion of said trigger, for augmenting trigger pressure.

11. A mechanism as recited in claim 2, further comprising a spring installed between an interior portion of said case and a portion of said trigger, for augmenting trigger pressure.

12. A mechanism as recited in claim 1, further comprising a spring installed between an interior portion of said case and a portion of said trigger, for augmenting trigger pressure.

* * * * *